US009255391B2

(12) United States Patent
Beltz et al.

(10) Patent No.: US 9,255,391 B2
(45) Date of Patent: Feb. 9, 2016

(54) SINK ASSEMBLY HAVING AN ENCLOSURE FORMED FROM A TIRE

(71) Applicant: Brian Beltz, Findlay, OH (US)

(72) Inventors: Brian Beltz, Findlay, OH (US); William P. Camp, Jr., Vanlue, OH (US)

(73) Assignee: Brian Beltz, Findlay, OH (US)

( * ) Notice: Subject to any disclaimer, the term of this patent is extended or adjusted under 35 U.S.C. 154(b) by 0 days.

(21) Appl. No.: 14/208,906

(22) Filed: Mar. 13, 2014

(65) Prior Publication Data

US 2014/0259379 A1 Sep. 18, 2014

Related U.S. Application Data

(60) Provisional application No. 61/778,804, filed on Mar. 13, 2013.

(51) Int. Cl.
*A47K 1/05* (2006.01)
*E03C 1/33* (2006.01)

(52) U.S. Cl.
CPC ..... *E03C 1/33* (2013.01)

(58) Field of Classification Search
USPC ..... 4/643, 636
See application file for complete search history.

(56) References Cited

U.S. PATENT DOCUMENTS 2,035,301 A * 3/1936 Daugherty ..... E03C 1/324 248/201
4,209,862 A * 7/1980 Cortes-Garza ..... 4/584
4,689,841 A * 9/1987 Owen ..... 4/644
7,665,160 B1 * 2/2010 Linder ..... A47K 1/04 285/208

OTHER PUBLICATIONS

The Tire Sink as shown in Oct. 2, 2010 & Jan. 9, 2008.*
The Tire Sink.*
NascarTire.com: Display Ideas, http://www.eteamz.com/sites/etirez/sponsors, printed on Jun. 10, 2014.

* cited by examiner

*Primary Examiner* — Lauren Crane
(74) *Attorney, Agent, or Firm* — Fraser Clemens Martin & Miller LLC; Jacob M. Ward

(57) ABSTRACT

A sink assembly includes a wash basin having a rim. The sink assembly further includes a tire having an opening therethrough to receive the wash basin. The rim of the wash basin engages the tire. A foam insert is disposed within the tire. A support assembly engages the tire and is configured for coupling the sink assembly to a supporting surface.

11 Claims, 6 Drawing Sheets

SINK ASSEMBLY HAVING AN ENCLOSURE FORMED FROM A TIRE

CROSS-REFERENCE TO RELATED APPLICATIONS

This application claims priority to U.S. Provisional Patent Application Ser. No. 61/778,804 filed on Mar. 13, 2013. The entire disclosure of the above application is hereby incorporated herein by reference.

FIELD OF THE INVENTION

The invention relates to a sink assembly, and more specifically to a sink assembly including a sink mounted in the central opening of a pneumatic tire.

BACKGROUND OF THE INVENTION

A sink member or wash basin is typically provided with a sink deck or countertop that surrounds at least a portion of the sink member. The deck is often adapted to support the sink member as well as other accessories such as a spigot, a spray nozzle, a soap dispenser, and the like. Additionally, the deck can provide a decorative appearance to a sink assembly, and can provide an extended and substantially planar surface for supporting other objects and forming a convenient work area.

Consumers often desire a sink assembly that has a decorative appearance, which conforms to a particular aesthetic design or motif of a bathroom, a kitchen, a laundry area, or other room having a sink assembly therein. The particular aesthetic design of the room may include an overall motif such as a sports theme, for example. Consumers that are automobile or motorcycle enthusiasts may choose to create an automobile, motorcycle, or transportation motif, and desire to have a compatible sink assembly.

Pneumatic tires can contribute to the automotive, motorcycle, or transportation motif of a decorated room. Additionally, used tires are currently difficult to dispose of in an environmentally friendly manner. The typical tire includes a plurality of rubber based compounds that do not readily decompose or lend themselves to simple recycling.

Pneumatic tires are typically flexible and adapted to fit over a wheel rim to receive a quantity of compressed air. The pneumatic tires there by achieve a desired stability and firmness. However, without the wheel rim and compressed air, the tires lack the required firmness and stability for suitable use in a sink assembly, as the tires may undesirably deform or deflect in operation.

There is a continuing need for a sink assembly including a tire, which creates a transportation motif sink assembly. Desirably, the sink assembly with the tire does not deform or deflect significantly, and provides for an environmentally friendly use of used tires.

SUMMARY OF THE INVENTION

In concordance with the instant disclosure, a sink assembly including a tire, which creates a transportation motif sink assembly, does not deform or deflect significantly, and which provide for an environmentally friendly use of a used tire, has surprisingly been discovered.

In one embodiment, a sink assembly includes a wash basin having a rim. The sink assembly further includes a tire having an opening therethrough to receive the wash basin. The rim of the wash basin engages the tire. A foam insert is disposed within the tire, thereby militating against deformation or deflection of the tire in operation.

In another embodiment, a sink assembly includes a wash basin having a rim, and a tire having an opening therethrough to receive the wash basin. The rim of the wash basin is sealably joined to an outer surface of the tire. A support assembly engages with the tire and is configured for coupling the sink assembly to a supporting surface. A foam insert is disposed on an inner surface of the tire, thereby militating against deformation or deflection of the tire in operation.

In a further embodiment, a kit for a sink assembly is disclosed. The kit includes a wash basin, a tire, a support assembly for supporting at least one of the wash basin and the tire, and a foam insert. The foam insert is configured to militate against deformation or deflection of the tire in operation.

BRIEF DESCRIPTION OF THE DRAWINGS

The above, as well as other objects and advantages of the disclosure, will become readily apparent to those skilled in the art from the following detailed description of an embodiment of the invention when considered in the light of the accompanying photographs, in which.

DETAILED DESCRIPTION OF THE INVENTION

Figure 1:
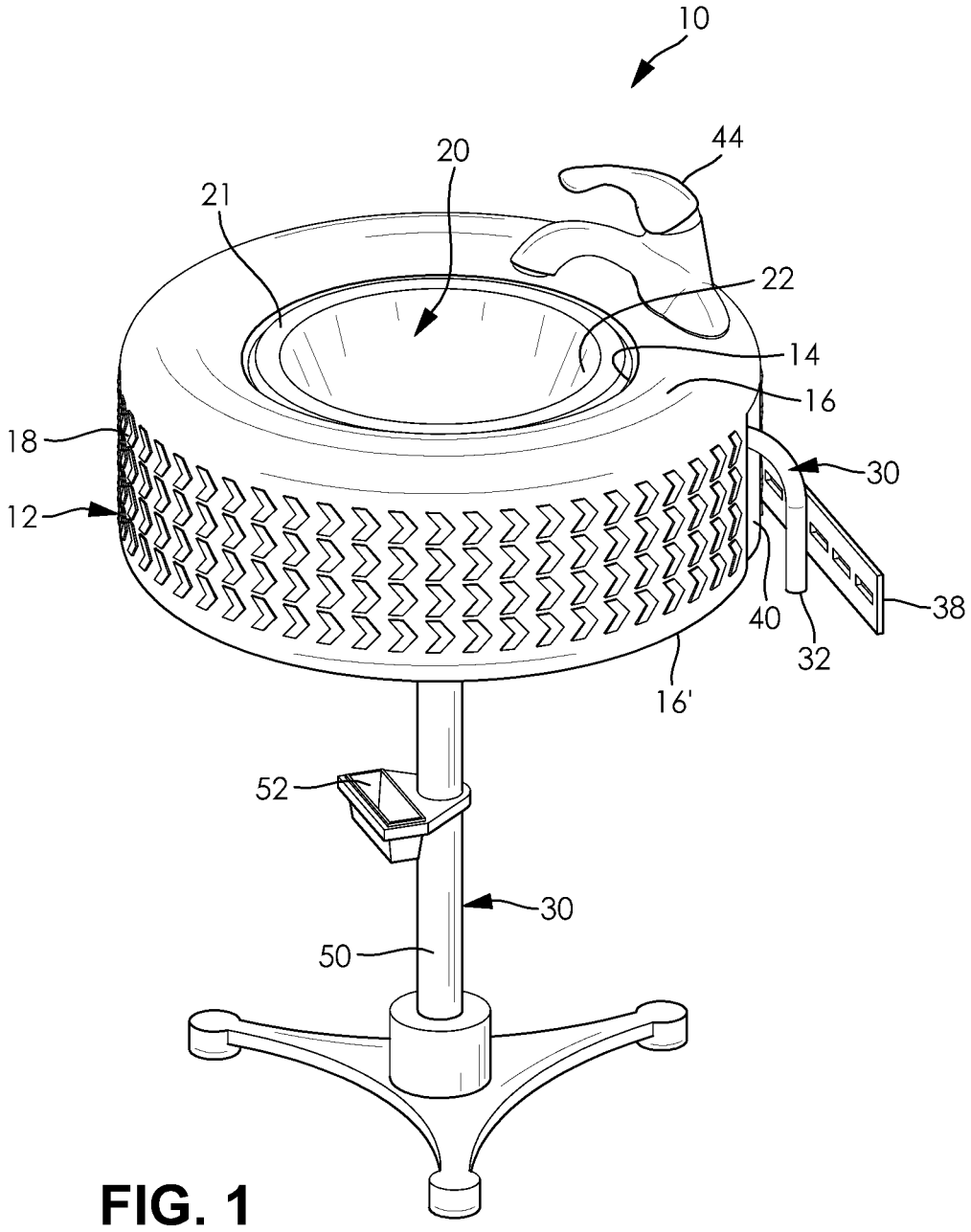
FIG. 1 is a top perspective view of a sink assembly according to an embodiment of the disclosure.

The following description is merely exemplary in nature and is not intended to limit the present disclosure, application, or uses. It should also be understood that throughout the drawings, corresponding reference numerals indicate like or corresponding parts and features.

Referring to FIGS. 1-4, there is illustrated a sink assembly 10 including a tire 12. The sink assembly 10 has an automotive or transportation theme. The tire 12 may have a pair of spaced apart annular beads 14, 14', which define an inside or a rim diameter of the tire 12. An opening 15 is formed through the tire 12 adjacent the annular beads 14, 14'. Each bead 14, 14' is coupled to an associated annular sidewall 16, 16' extending radially outwardly therefrom. A tread portion 18 is disposed between and integrally formed with the sidewalls 16, 16'.

In the embodiment illustrated in FIGS. 1-4, the tire 12 is a passenger car tire. It should be understood that any other brand of tire including racing tires, radial medium truck tires, light truck tires, motorcycle tires and the like, may also be employed within the scope of the disclosure. The tire 12 may also be a manufactured piece, for example, a molded piece, in the overall shape and having the general appearance of a real tire. The manufactured piece may have a sidewall and a tread portion, but lack internal structure or components otherwise used in road tires such as wire belts, plys, beads, etc. In other words, the tire 12 does not need to be suitable for road use in order to be used in the sink assembly 10 of the present disclosure. Additionally, it should be understood that other types of tires may be employed such as motorcycle tires, tractor tires, and airplane tires, for example.

The sink assembly 10 further includes a sink member or wash basin 20 and a support assembly 30. The wash basin 20 is received in the opening 15 of the tire 12 formed by the beads 14, 14'. The wash basin 20 has a generally circular-shaped upper end having an annular rim 21 extending radially outwardly therefrom. A sidewall 22 depends from an inner edge of the rim 21. The sidewall 22 extends to and is integrally formed with a bottom wall 24 of the wash basin 20. The bottom wall 24 may slope outwardly from the sidewall 22 to an aperture or drain 26 formed in the bottom wall 24. The drain 26 facilitates a draining a liquid such as wash water from the wash basin 20. The rim 21 contacts a surface of the tire 12 adjacent one of the beads 14, 14' and the associated sidewall 16, 16'.

A sealant material (not shown) can be interposed between the surface of the tire 12 and the rim 21, and form a substantially fluid tight seal therebetween. In certain embodiments, a silicone based liquid sealant is employed. However, it should be understood that other types of sealants or gaskets, having suitable physical properties for the formation of the substantially fluid tight seal, may be employed as desired.

Figure 2:
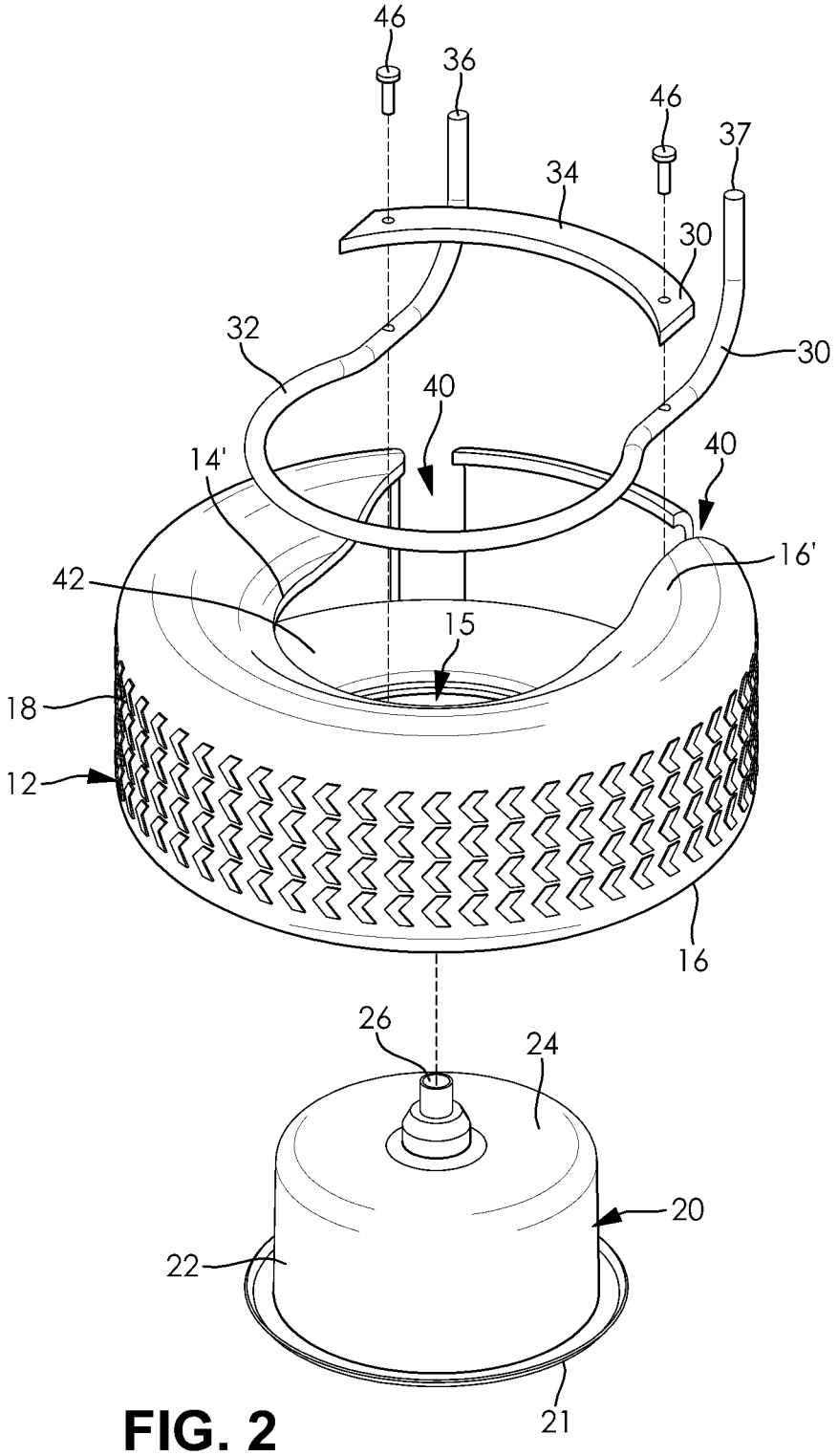
FIG. 2 is an exploded bottom perspective view of the sink assembly shown in claim 1, further shown without a support assembly.

The support assembly 30 is configured to support the tire 12 and the wash basin 20, and to facilitate a securing of the tire 12 and wash basin 20 to a supporting surface such as a wall or a floor. As shown in FIG. 2, for example, the support assembly 30 may include a frame 32 and a support member 34. The frame 32 has opposing ends 36, 37 and is formed in a shape configured to conform to a diameter of the side walls 16, 16' of the tire 12. The frame 32 may be tubular, as shown in FIG. 2. However, it should be understood that the frame 32 can be formed from substantially planar strips, or can any other suitable shape, as desired.

The ends 36, 37 of the frame 32 may be configured for coupling to a bracket 38 (shown in FIG. 1). The bracket 38 may be, in turn, configured for coupling to a supporting surface such as a wall. In a particular embodiment, the tubes forming the frame 32 can be approximately 1" in diameter. One of ordinary skill in the art understands that other suitable dimensions can be employed.

Figure 3:
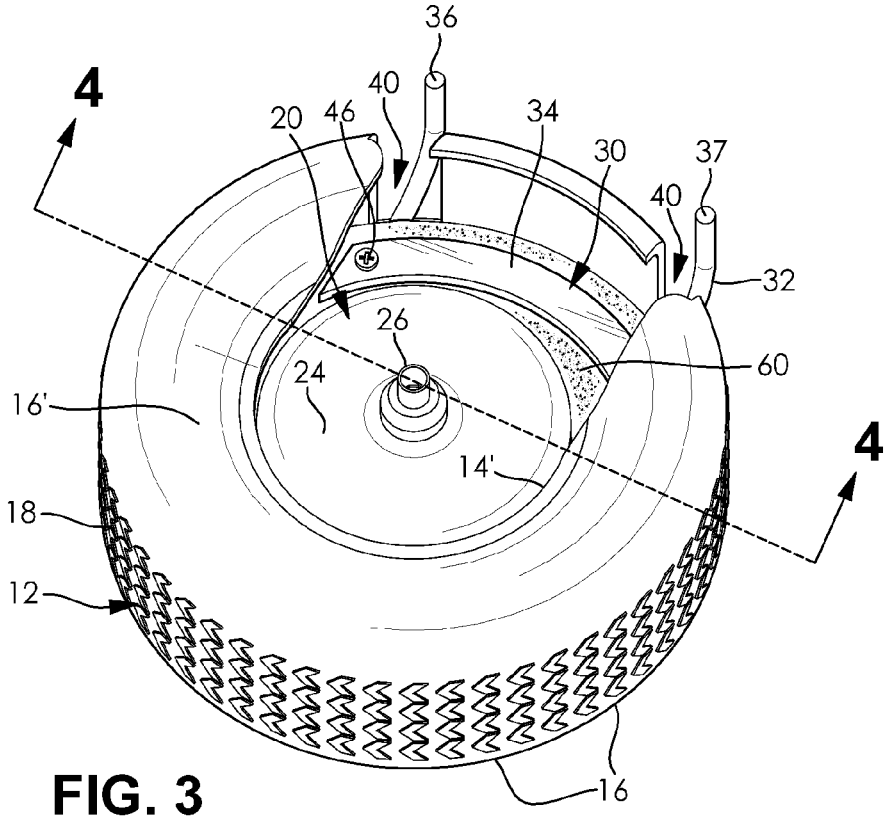
FIG. 3 is a bottom perspective view of the sink assembly shown in claim 1, further shown without a support assembly.
Figure 4:
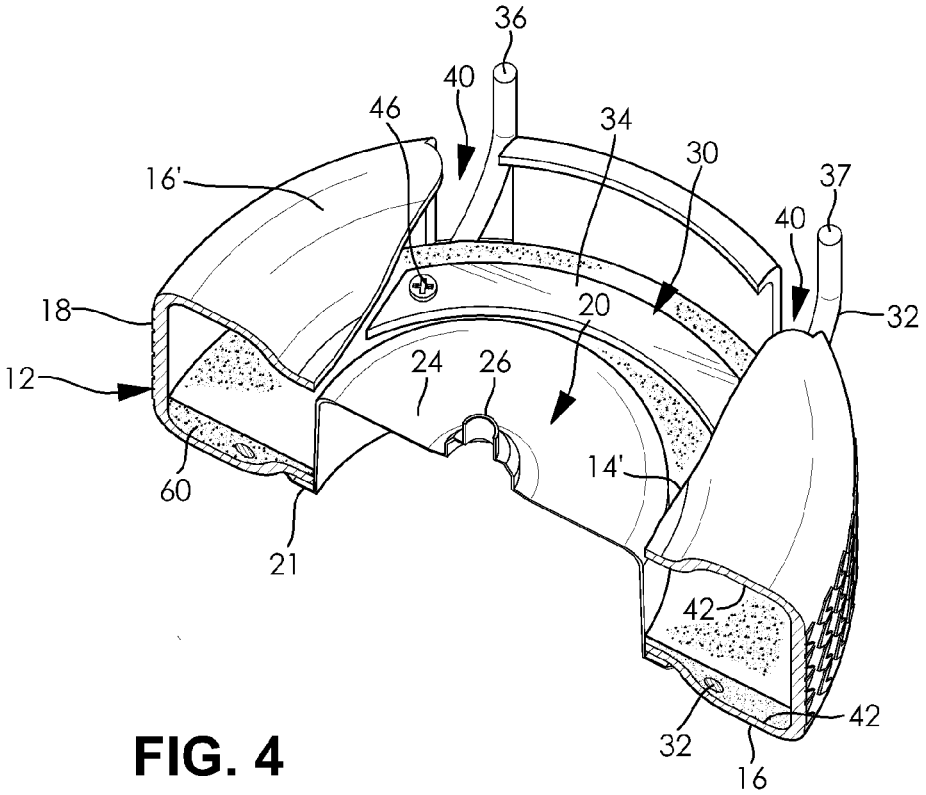
FIG. 4 a cross-sectional bottom perspective view of the sink assembly taken along line 4-4 in FIG. 3.

With renewed reference to FIGS. 2-4, it should be appreciated that slots 40 may be formed in the tire 12 to receive the frame 32 of the support assembly 30. The slots 40 may be formed through the tread portion 18 of the tire 12, and extend to one of the sidewalls 16, 16'. For example, there may be two slots 40 that extend to the sidewall 16', which is disposed opposite the rim 21 of the wash basin 20. Any number of slots or openings can be provided, as desired, to receive a bracket or the support assembly 30. As a further example, there may be one continuous slot 40, or multiple slots 40 defined as apertures formed through the tread potion 18 or sidewalls 16, 16'.

During assembly, the frame 32 may be disposed on an inner surface 42 of the sidewall 16 opposite the rim 21 of the wash basin 20. The frame 32 may be aligned with the slots 40, such that the opposing ends 36, 37 extend outwardly from the tire 12 and are configured to attach to the bracket 38 or the supporting surface. Fasteners may be employed to secure the support assembly 30 to the supporting surface. The fasteners may be threaded fasteners, such as screws or bolts, for example, or other attachment means such as nails, rivets, or an adhesive. Other suitable fasteners may also be selected by one of ordinary skill in the art.

As depicted in FIG. 3, the support member 34 may be disposed on the inner surface 42 of the sidewall 16. The support member 34 facilitates a securing the frame 32 to the inner surface 42. The support member 34 may be arcuate in shape, in order to conform to the shape of the tire 12. However, the support member 34 can have any suitable shape including rectangular, circular, triangular, ovular, and the like, as desired.

The support member 34 may have apertures for receiving fasteners 46, such as threaded fasteners or other coupling means, for securing the support assembly 30 to the tire 12. However, other suitable fastening means can be used such as such as nails, rivets, or an adhesive, for example.

In certain embodiments, the support member 34 is configured to support a fixture 44 such as a spigot, faucet, spray nozzle, or other sink accessory or hardware. The support member 34 can further include any necessary apertures for receiving components of the fixture 44. The support member 34 can be any material designed for supporting or securing the fixture 44 to the tire 12, such as plywood or masonite, as nonlimiting examples. Other suitable materials for the support member 34 may also be used, as desired.

With renewed reference to FIG. 1, the support assembly 30 can include a pedestal member 50. The pedestal member 50 further supports the tire 12 and the wash basin 20 above a floor, for example. The pedestal member 50 can also serve as a cover to conceal a drainage system coupled to the drain 26 of the wash basin 20. The sink assembly 10 can further include a tray 52 disposed beneath the tire 12 for placement of sink-related items (such as soaps, wash clothes, etc.) and tools.

In the embodiment illustrated in FIG. 3-4, a foam insert 60 can be disposed within the tire 12. For example, the foam insert 60 may be disposed over the frame 32 and against the inner surface 42 of the tire 12. The foam may or may not abut the support member 34, as desired. The foam insert 60 may be a freely expanding foam material, or may be a preformed foam insert, as desired. The foam insert 60 militates against a deformation or deflection of the tire 12. The foam insert 60 may be a closed cell polyurethane foam material, for example, formed by spraying or pouring a two-part liquid, expanding rigid urethane foam within the tire 12. One of ordinary skill in the art may select other suitable materials for the foam insert 60, as desired.

Where the foam insert 60 is a freely expanding foam material, the foam insert 60 expands during assembly and rigidly adheres to the inner surface 42 of the tire 12 to facilitate a securing of the support assembly 30 to the tire 12. The foam insert 60 also helps to rigidly adhere and support the wash basin 20. It should be understood that any freely expandable foam, gasket, or other sealant configured to provide rigidity and adhesion can be used, such as urethane foam.

In certain embodiments, a clear polymer coating may be applied to at least a portion of the outer surface of the tire 12. The coating provides a protective covering to any text, graphics, or other markings on the outer surface of the tire 12. Additionally, the coating can facilitate cleaning the outer surface of the tire 12, and militate against oil or other substances disposed on the outer surface, or leaching from within the tire 12 to the outer surface, from transferring to a user of the sink assembly 10.

In the illustrated embodiment of FIG. 1, the sink assembly 10 is employed as a vanity or a wash basin for a lavatory. However, it should be understood that the sink assembly 10 may be adapted for other uses such as a utility sink, a kitchen sink, or a parts washer, as nonlimiting examples.

Figure 5:
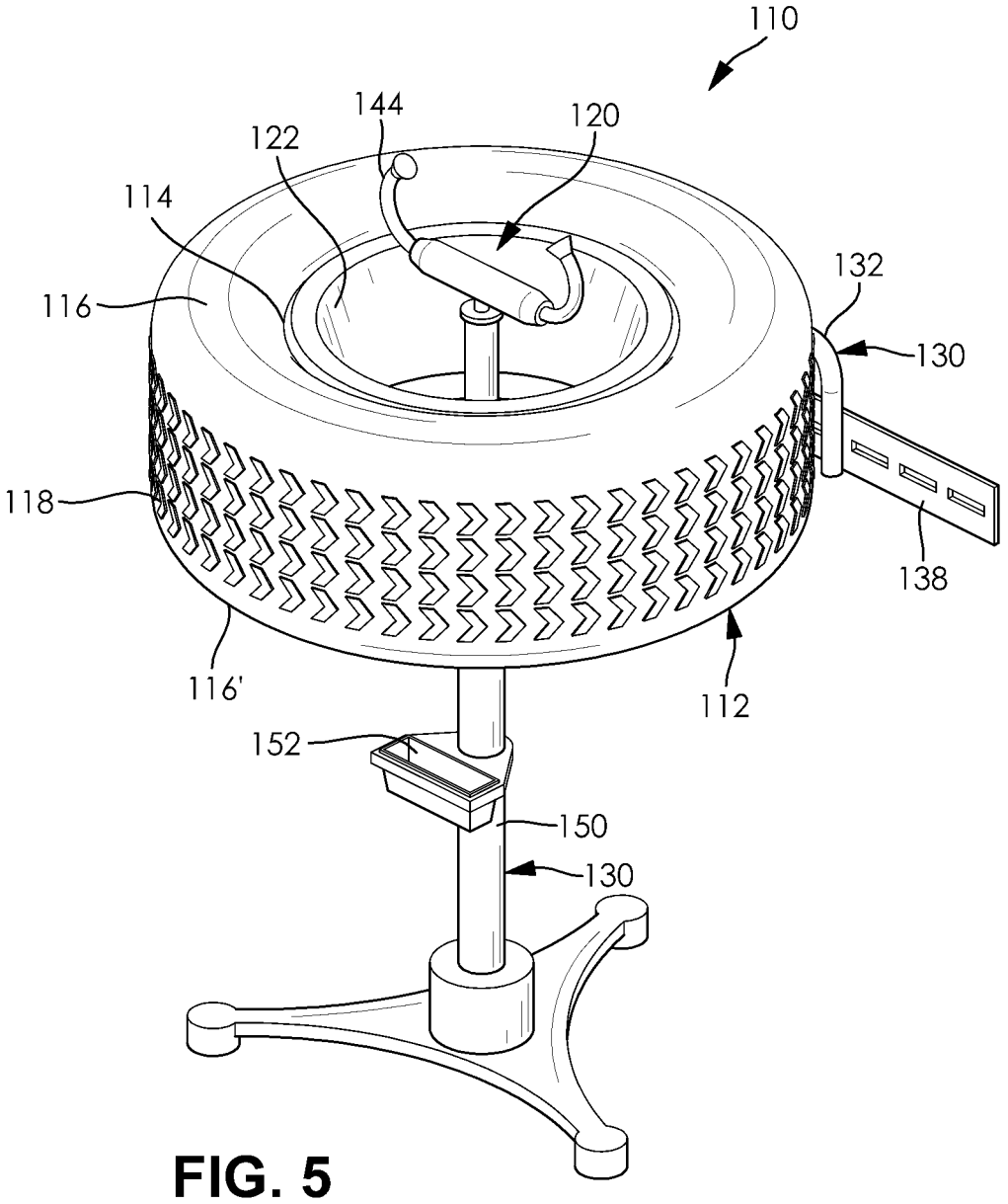
FIG. 5 is a top perspective view of a sink assembly according to another embodiment of the disclosure.

In the embodiment illustrated in FIG. 5, the sink assembly 110 is an eyewash station. Like or related structure from FIGS. 1-4 is shown in FIG. 5 with a same reference number in a 100-series, for purposes of clarity. The sink assembly 110 illustrated in FIG. 5 is substantially similar to the sink assembly 10 shown in FIGS. 1-4 and described hereinabove except the fixture 144 is an eye spraying faucet. The fixture 144 is disposed in the center of the wash basin 120 so the fixture 144 can properly drain when used.

Figure 6:
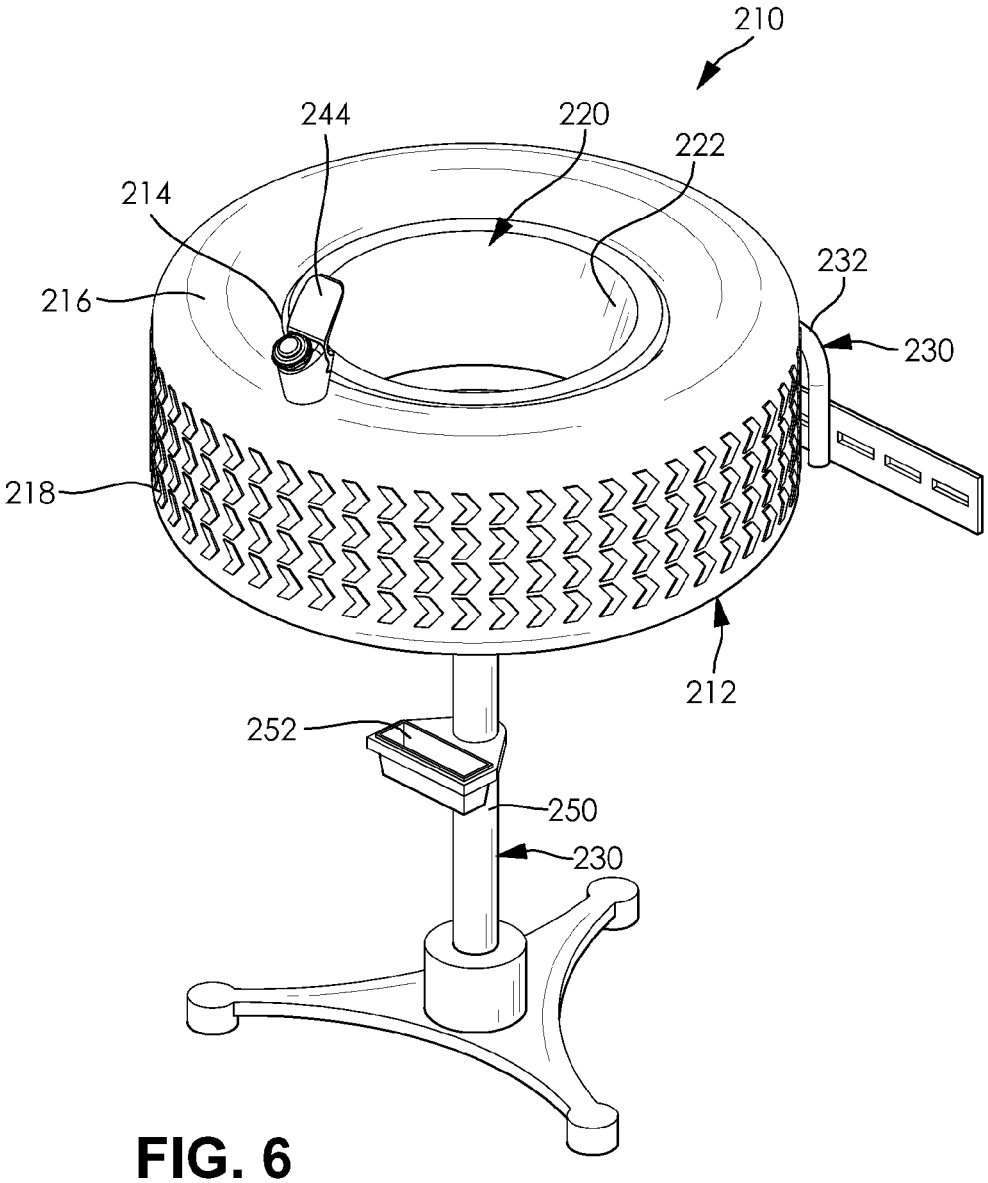
FIG. 6 is a top perspective view of a sink assembly according to a further embodiment of the disclosure.

In the embodiment illustrated in FIG. 6, the sink assembly 210 is a drinking fountain having a pedestal member 250. Like or related structure from FIGS. 1-5 is shown in FIG. 6 with a same reference number in a 200-series, for purposes of clarity. The sink assembly 210 illustrated in FIG. 6 is substantially similar to the sink assembly 10, 110 shown in FIGS. 1-5 and described hereinabove except the fixture 244 is a drinking fountain nozzle. The nozzle is disposed at an opposing end of the tire 212 from the support assembly 230.

Figure 7:
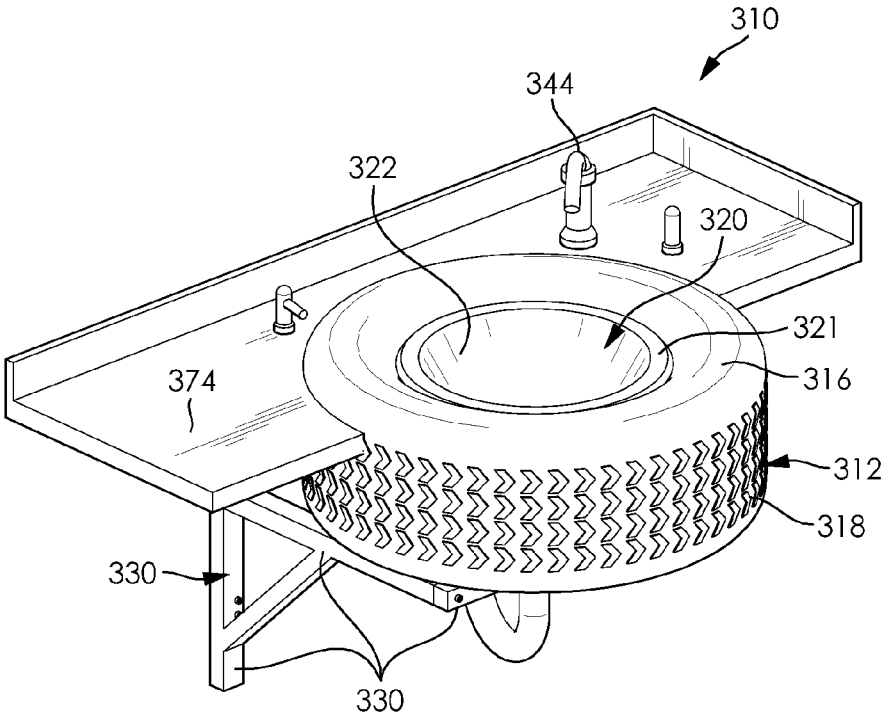
FIG. 7 is a top perspective view of a sink assembly according to yet another embodiment of the disclosure.
Figure 8:
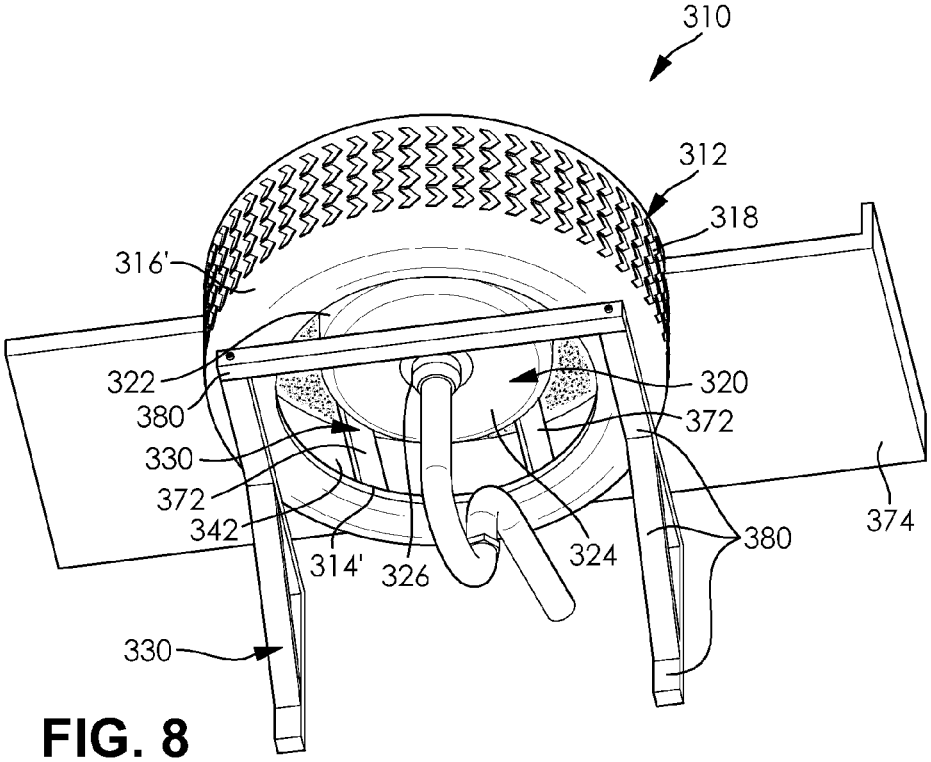
FIG. 8 is a bottom perspective view of the sink assembly shown in FIG. 7.

FIGS. 7-8 illustrate a sink assembly 310 according to a further embodiment. Like or related structure from FIGS. 1-6 is shown in FIGS. 7-8 with a same reference number in a 300-series, for purposes of clarity. The support assembly 330 of the sink assembly 310 includes a plurality of elongate members 380 formed from angle iron and adapted to contact and support an outer surface of the sidewall 316' of the tire 312. Threaded fasteners can be employed to secure the tire 12 to the support assembly 330. However, other fastening means can be used such as such as nails, rivets, or an adhesive, for example. The elongate members 380 are adapted to contact and be secured to the supporting surface such as a wall (not shown). Threaded fasteners are typically employed to secure the support assembly 330 to the supporting surface. It should be understood that means other than threaded fasteners may be employed to secure the support assembly 330 to the supporting surface such as nails, rivets, an adhesive, or the like, as desired.

A plurality of vertical members 372 may be interposed between the sidewalls 316, 316' on the inner surface 342 of the tire 312, for example, as shown in FIG. 8. The vertical members 372 maintain a desired vertical distance between the sidewalls 316, 316'. In the illustrated embodiment, the vertical members 372 are formed from wood or a composite material. It should be understood that any other suitable material may be employed to form the vertical members 372 such as metal or plastic material, for example. Further, it should be understood that an end or a side of the vertical members 372 can be contoured to substantially conform to a profile of the inner surface 342 of the tire 312.

In another embodiment, also shown in FIGS. 7-8, a sink deck or countertop 374 can be provided to surround at least a portion of the tire 312. The countertop 374 provides a convenient work surface and supports selected fixtures 344 such as a spigot, a spray nozzle, and a soap dispenser. The fixtures 344 may be offset from the tire 312. Other fixtures may be attached to the countertop 374 as desired. The countertop 374 may be attached to either or both the supporting surface and the support assembly 330.

A sealant material may be interposed between the surface of the tire 312 and the countertop 374, in order to form a substantially fluid tight seal therebetween. In the certain embodiments, a silicone-based liquid sealant is employed. It should be understood that other types of sealants or gaskets having suitable physical properties may be employed to form the substantially fluid tight seal between the surface of the tire 312 and the countertop 374. The countertop 374 can be any suitable material such as porcelain, tile, or plastic, for example.

Additionally, although the illustrated embodiments show a whole tire 12, 112, 212, 312 being employed to form the sink assembly 10, 110, 210, 310, it should be understood that the tire 12, 112, 212, 312 may be cut and a selected portion of the tire 12 can be employed to form the sink assembly.

The sink assembly 10, 110, 210, 310 can be packaged and sold together as a kit. The tire 12, 112, 212, 312, wash basin 20, 120, 220, 320, and support assembly 30, 130, 230, 330 can be sold together to enable a user to construct and install the sink assembly. Additionally, the fixtures can be included with the kit along with other materials such as the sealant and the foam insert 60, 160, 260, 360; any required fasteners; and the required plumbing accessories such as a drain assembly, water supply conduits, water valves, and plumbers putty, for example.

Advantageously, the sink assembly 10, 110, 210, 310 of the present disclosure provides a decorative sink assembly having an automotive or transportation theme, which can be employed to enhance the decorative appearance of a room. Additionally, the sink assembly 10, 110, 210, 310 provides an environmentally responsible use of a used tire, which may otherwise be placed in a landfill or discarded in some other environmentally undesirable manner.

While certain representative embodiments and details have been shown for purposes of illustrating the present disclosure, it will be apparent to those skilled in the art that various changes may be made without departing from the scope of the disclosure, which is further described in the following appended claims.

What is claimed is:

1. A sink assembly comprising:

a wash basin having a rim;

a tire having a first sidewall, a second sidewall, a tread, and an opening formed therethrough within which the wash basin is received, the first sidewall having an outer surface and an inner surface, both the outer surface and the inner surface substantially oriented along a horizontal plane and disposed between the tread and the opening of the tire, the rim of the wash basin engaging the adjacent the outer surface of the first sidewall; and a foam insert disposed within the tire, the foam insert filling only a portion of the tire and abutting an entirely of the inner surface of the first sidewall and not abutting the second sidewall, the foam insert militating against a deformation or deflection of the first sidewall of the tire.

2. The sink assembly of claim 1, wherein the foam insert is formed from afreely expandable foam material.

3. The sink assembly of claim 1, wherein the foam insert is polyurethane.

4. The sink assembly of claim 1, wherein the foam insert is at least partially disposed on the wash basin.

5. The sink assembly of claim 1, further comprising a support assembly configured for coupling the sink assembly to a supporting surface, the support assembly including a frame that is partly embedded in the foam insert and which has ends extending through slots in the tread of the tire for coupling to the supporting surface.

6. The sink assembly of claim 5, wherein the frame has a portion with a shape corresponding to a shape of an interior of the tire.

7. The sink assembly of claim 1, further including at least one of a countertop surrounding at least a portion of the tire and a pedestal stand engaging at least one of the wash basin and the tire.

8. The sink assembly of claim 1, wherein the tire is coated with a sealant.

9. The sink assembly of claim 1, further comprising a fixture disposed on at least one of the tire and the wash basin.

10. A sink assembly comprising:

a wash basin having a rim;

a tire having a first sidewall, a second sidewall, a tread and an opening formed therethrough within which the wash basin is received, the first sidewall having an outer surface and an inner surface, both the outer surface and the inner surface substantially oriented along a horizontal plane and disposed between the tread and the opening of the tire, the rim of the wash basin engaging the tire adjacent the outer surface of the first sidewall, and the rim of the wash basin joined to and forming a substantially fluid tight seal with the outer surface of the first sidewall of the tire;

a foam insert disposed within the tire, the foam insert filling only a portion of the tire and abutting an entirely of the inner surface of the first sidewall and not abutting the second sidewall, the foam insert militating against a deformation or deflection of the first sidewall of the tire;

a fixture disposed on the outer surface of the first sidewall of the tire; and a support assembly engaging the tire and configured for coupling the sink assembly to a supporting surface, the support assembly including a frame that is partly embedded in the foam insert and which has ends extending through slots formed in the tread of the tire for coupling to the supporting surface, the support assembly further including a support member disposed in an interior of the tire adjacent the first sidewall and supporting the fixture.

11. The sink assembly of claim 10, wherein the foam insert is formed from a freely expandable foam material.

* * * * *